US011598117B2

(12) United States Patent
DeLuso

(10) Patent No.: US 11,598,117 B2
(45) **Date of Patent: *Mar. 7, 2023**

(54) GATE CORNER INSERT

(71) Applicant: Eastern Wholesale Fence LLC, Medford, NY (US)

(72) Inventor: Christopher DeLuso, Massapequa, NY (US)

(73) Assignee: Eastern Wholesale Fence LLC, Medford, NY (US)

( * ) Notice: Subject to any disclaimer, the term of this patent is extended or adjusted under 35 U.S.C. 154(b) by 50 days.

This patent is subject to a terminal disclaimer.

(21) Appl. No.: 17/109,327

(22) Filed: Dec. 2, 2020

(65) Prior Publication Data

US 2021/0087847 A1 Mar. 25, 2021

Related U.S. Application Data

(63) Continuation of application No. 15/959,719, filed on Apr. 23, 2018, now Pat. No. 10,883,291.

(51) Int. Cl.
*E04H 17/14* (2006.01)

(52) U.S. Cl.
CPC ..... *E04H 17/1417* (2013.01); *E04H 17/1447* (2021.01); *E04H 17/1465* (2021.01)

(58) Field of Classification Search
CPC ..... F16B 21/00; F16B 21/08; F16B 21/082; F16B 19/00; A44B 17/00; E04H 2017/1447; E04H 2017/1473; E04H 2017/1478; E04H 17/1413; E04H 17/1421; E04H 17/1426; E04H 17/1439; E04H 17/1443; E04H 17/1465; Y10T 403/4648; Y10T 403/4651; Y10T 403/4654; Y10T 403/4637
See application file for complete search history.

(56) References Cited

U.S. PATENT DOCUMENTS 3,195,864 A * 7/1965 Case ..... E04H 17/1413 256/65.11
3,722,701 A 3/1973 Malcik et al.
3,837,754 A 9/1974 Malcik
(Continued)

FOREIGN PATENT DOCUMENTS

FR 599097 A * 6/1925

*Primary Examiner* — Daniel J Wiley
(74) *Attorney, Agent, or Firm* — Scully Scott Murphy & Presser

(57) ABSTRACT

A gate assembly is disclosed including a gate rail and an upright including a plurality of walls defining a cavity therebetween. A first of the walls includes an opening that is configured to receive the gate rail therethrough such that the gate rail extends into the cavity. The gate assembly further includes a gate corner insert configured for insertion into the cavity of the upright through a second opening of the upright. The gate corner insert includes a base and a plurality of protrusions extending from the base. The base and the plurality of protrusions define a second cavity therebetween with first and second protrusions of the plurality of protrusions defining a third opening in communication with the second cavity. The third opening and the second cavity are configured to receive the gate rail therein for removable attachment to the gate corner insert.

7 Claims, 7 Drawing Sheets

(56) References Cited

U.S. PATENT DOCUMENTS

| | | | | |
|---|---|---|---|---|
| 5,651,534 | A * | 7/1997 | Yoder | E04H 17/1413 256/65.13 |
| 7,082,734 | B2 | 8/2006 | Rowan | |
| 2004/0256609 | A1 * | 12/2004 | Mills | E04H 17/1413 256/65.12 |

* cited by examiner

SECTION B-B

GATE CORNER INSERT

This application is a continuation of, and claims benefit of priority under 35 U.S.C. § 120 to, co-pending patent application U.S. Ser. No. 15/959,719 filed Apr. 23, 2018, the entire contents of which are incorporated herein by reference.

FIELD

The present disclosure relates to an insert for removably attaching a gate rail to a gate upright.

BACKGROUND

Fence gates are often used to provide an access point to an area enclosed by or on an opposite side of a fence. Often a gate will be pre-assembled in a factory and transported to a work site for installation. In some cases, an installer may forego the use of a pre-assembled gate and may instead try to assembly a gate manually. For example, the installer may cut holes into an upright, insert a rail, and attempt to secure the rail within the upright in a variety of different ways. For example, the installer may attempt to secure the rail in the upright by wedging small pieces of gate or other material into the space around the rail, use rail pockets in the side of the upright, or in other similar manners. In some cases, the installer may even drive fasteners through an exterior wall of the upright in an attempt to secure the rail, which may not be aesthetically pleasing to an owner of the property where the fence is installed.

BRIEF SUMMARY

In an aspect, a gate corner insert configured for insertion into an upright is disclosed. The gate corner insert includes a base and a plurality of protrusions extending from the base. The base and the plurality of protrusions define a cavity therebetween. First and second protrusions of the plurality of protrusions define an opening therebetween in communication with the cavity. The opening and the cavity are configured to receive a gate rail therein for removable attachment to the gate corner insert. The removable attachment inhibits removal of the gate rail from the opening.

In another aspect, the base includes at least one hole extending therethrough. The at least one hole is configured to receive a fastener therethrough for engagement against the gate rail when the gate rail is received within the opening and the cavity. The engagement of the fastener against the gate rail removably attaches the gate rail to the gate corner insert.

In some aspects, third and fourth protrusions of the plurality of protrusions define a second opening therebetween in communication with the cavity. The second opening is disposed on an opposite side of the cavity from the opening and configured to receive the gate rail therein.

In yet another aspect, the first and second protrusions inhibit lateral movement of the gate rail when the gate rail is received within the cavity and first opening.

In an aspect, a third protrusion of the plurality of protrusions and the first protrusion define a second opening therebetween in communication with the cavity. The opening has a first width and the second opening has a second width. The second width is different than the first width. The second opening is configured to receive a gate rail therein that has a different width than the width of a gate rail that the opening is configured to receive.

In some aspects, the opening is configured to receive a gate rail in a first direction, the second opening is configured to receive a gate rail in a second direction, and the first direction is orthogonal to the second direction. In yet a further aspect, the first and second directions are orthogonal to a direction that the plurality of protrusions extend from the base.

In an aspect, a gate assembly is disclosed including a gate rail and an upright including a plurality of walls. The plurality of walls define a cavity therebetween. A first of the walls includes an opening that is configured to receive the gate rail therethrough such that the gate rail extends into the cavity. The gate assembly further includes a gate corner insert configured for insertion into the cavity of the upright through a second opening of the upright. The gate corner insert includes a base and a plurality of protrusions extending from the base. The base and the plurality of protrusions define a second cavity therebetween. First and second protrusions of the plurality of protrusions define a third opening therebetween in communication with the second cavity. The third opening and the second cavity are configured to receive the gate rail therein for removable attachment to the gate corner insert. The removable attachment inhibits removal of the gate rail from the upright.

In some aspects, the base includes at least one hole extending therethrough. The at least one hole is configured to receive a fastener therethrough for engagement against the gate rail when the gate rail is received within the third opening and the second cavity. The engagement of the fastener against the gate rail removably attaches the gate rail to the gate corner insert.

In another aspect, third and fourth protrusions of the plurality of protrusions define a fourth opening therebetween in communication with the second cavity. The fourth opening is disposed on an opposite side of the cavity from the third opening and configured to receive the gate rail therein.

In yet another aspect, the first and second protrusions inhibit lateral movement of the gate rail within the cavity of the upright when the gate rail is received within the second cavity and third opening.

In some aspects, a third protrusion of the plurality of protrusions and the first protrusion define a fourth opening therebetween in communication with the second cavity. The third opening has a first width and the fourth opening has a second width. The second width is different than the first width. The fourth opening is configured to receive a gate rail therein that has a different width than the width of a gate rail that the third opening is configured to receive.

In another aspect, the third opening is configured to receive a gate rail in a first direction, the fourth opening is configured to receive a gate rail in a second direction, and the first direction is orthogonal to the second direction. In a further aspect, the first and second directions are orthogonal to a direction that the plurality of protrusions extend from the base.

In some aspects, the gate corner insert is configured for insertion into the cavity of the upright such that the plurality of protrusions extend from the base toward gate rail when the gate rail is received through the opening and in the cavity of the upright.

In an aspect, a method for removably attaching a gate rail to an upright is disclosed including inserting the gate rail into a cavity defined by a plurality of walls of the upright through an opening in a first wall of the plurality of walls of the upright and inserting a gate corner insert into the cavity of the upright through a second opening of the upright defined by the plurality of walls. The gate corner insert includes a base and a plurality of protrusions extending from the base. The base and the plurality of protrusions define a second cavity therebetween. First and second protrusions of the plurality of protrusions define a third opening therebetween in communication with the second cavity. The method further including positioning the gate corner insert within the cavity relative to the gate rail such that the gate rail is received within the second cavity and the third opening of the gate corner insert and removably attaching the gate rail to the gate corner insert to inhibit removal of the gate rail from the cavity of the upright.

In some aspects, removably attaching the gate rail to the gate corner insert includes inserting a fastener through a hole in the base and into engagement with the gate rail. The engagement of the fastener with the gate rail removably attaches the gate rail to the gate corner insert.

In some aspects, the first and second protrusions inhibit lateral movement of the gate rail within the cavity of the upright when the gate rail is received within the second cavity and third opening.

In yet another aspect, inserting the gate corner insert into the cavity of the upright includes inserting the gate corner insert into the upright such that the plurality of protrusions extend from the base toward gate rail when the gate rail is received through the opening and in the cavity of the upright.

In some aspects, a third protrusion of the plurality of protrusions and the first protrusion define a fourth opening therebetween in communication with the second cavity. The third opening has a first width and the fourth opening has a second width. The second width is different than the first width. The method further includes determining that a width of the gate rail corresponds to the first width and rotating the gate corner insert prior to insertion of the gate corner insert into the cavity of the upright such that the third opening is aligned with an insertion direction of the gate rail through the opening.

Any of the above aspects may be combined in any manner without departing from the scope of the present disclosure.

BRIEF DESCRIPTION OF THE DRAWINGS

The details of the present disclosure, both as to its structure and operation, can best be understood by referring to the accompanying drawings, in which like reference numbers and designations refer to like elements.

DETAILED DESCRIPTION

Figure 1:
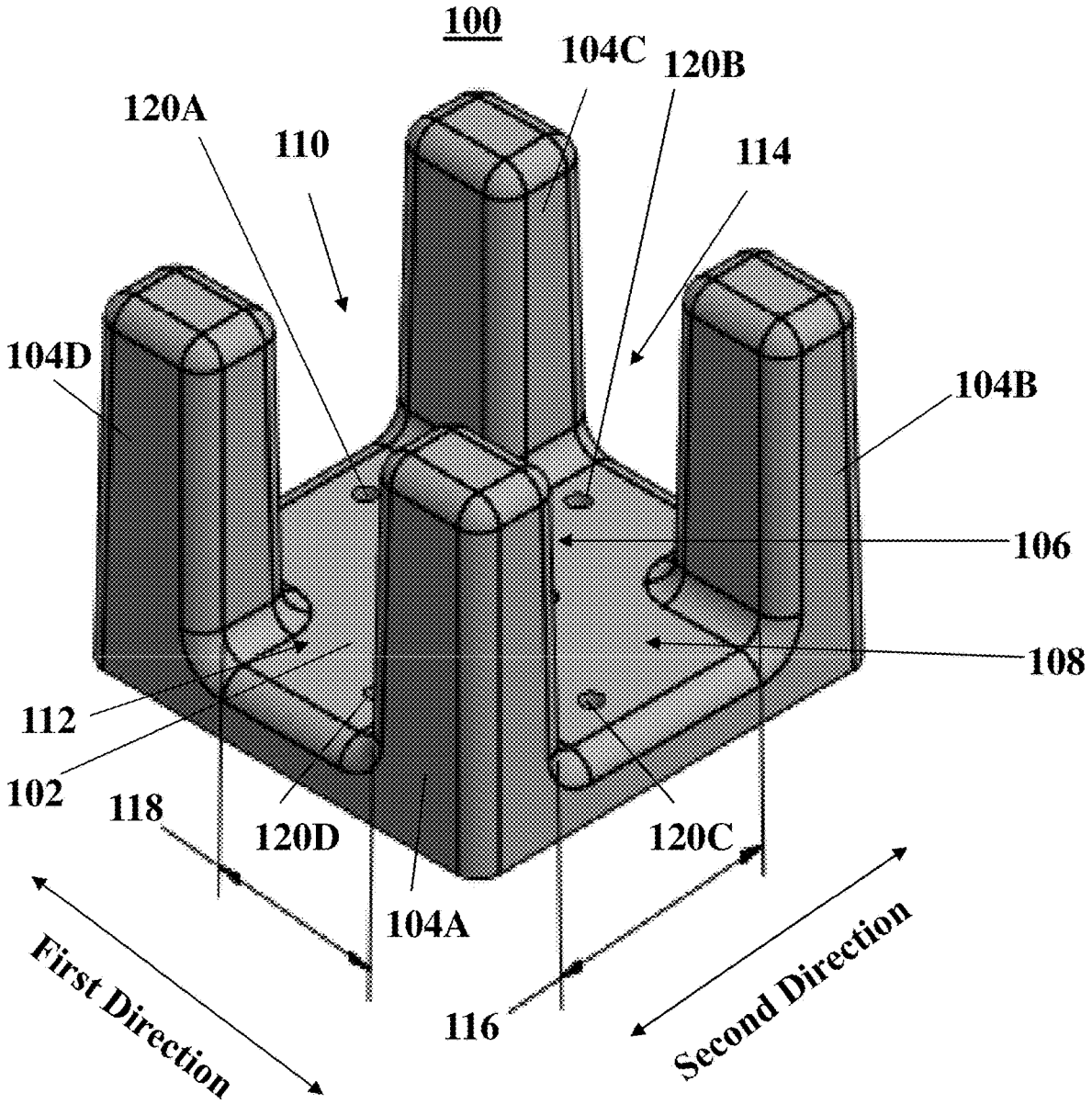
FIG. 1 is a perspective view of a gate corner insert in accordance with an aspect of the present disclosure.

With reference now to FIGS. 1-4, a gate corner insert 100 is illustrated. Gate corner insert 100 includes a base 102, and protrusions 104A-D, e.g., fingers, extending from the base. In some aspects, for example, as illustrated in FIG. 1, four protrusions may be included in the gate corner insert 100. In some aspects, a larger or smaller number of protrusions may be included. For example, no protrusions, one protrusion, two protrusions, three protrusions, four protrusions, five protrusions, six protrusions, seven protrusions, eight protrusions, or more protrusions may be included.

Protrusions 104A-D may extend orthogonally from base 102 or at any other angle. As illustrated in FIG. 1, for example, protrusions 104A-104D extend orthogonally from base 102 and are spaced apart from one another to define a cavity 106 therebetween.

Protrusions 104A and 104B define an opening 108 therebetween that is dimensioned to receive a gate rail, e.g., in a first direction. Protrusions 104C and 104D also define an opening 110 therebetween that is dimensioned to receive the gate rail in the first direction. For example, a gate rail may be inserted in the first direction through opening 108 between protrusions 104A and 104B, through cavity 106, and through opening 110 between protrusions 104C and 104D on an opposite side of cavity 106 from opening 108 in the first direction. In some aspects, for example, the first direction may be orthogonal to a direction that the protrusions 104A-D extend from base 102.

With continued reference to FIGS. 1-4, protrusions 104A and 104D define an opening 112 therebetween that is dimensioned to receive a gate rail, e.g., in a second direction. Protrusions 104B and 104C also define an opening 114 therebetween that is dimensioned to receive the gate rail in the second direction. For example, a gate rail may be inserted in the second direction through the opening 112 between protrusions 104A and 104D, through cavity 106, and through opening 114 between protrusions 104B and 104C on an opposite side of cavity 106 from opening 112 in the second direction. In some aspects, for example, the second direction may be orthogonal to a direction that the protrusions 104A-D extend from base 102. In some aspects, the second direction may be orthogonal to the first direction.

In some aspects, a width 116 of openings 108 and 110 may be the same as a width 118 of openings 112 and 114. In some aspects, the width 116 may be greater than the width 118. For example, width 116 may be dimensioned to receive a gate rail having a first width, e.g., a gate rail having a width of two inches (2") while width 118 may be dimensioned to receive a gate rail having a second width, e.g., a gate rail having a width of one and a half inches (1.5"). Having openings with different widths allows gate corner insert 100 to be used with a variety of gate rails. For example, depending on the width of the gate rail, gate corner insert 100 may be rotated prior to insertion into the upright to present the opening that has a width dimensioned to receive that gate rail.

Figure 7:
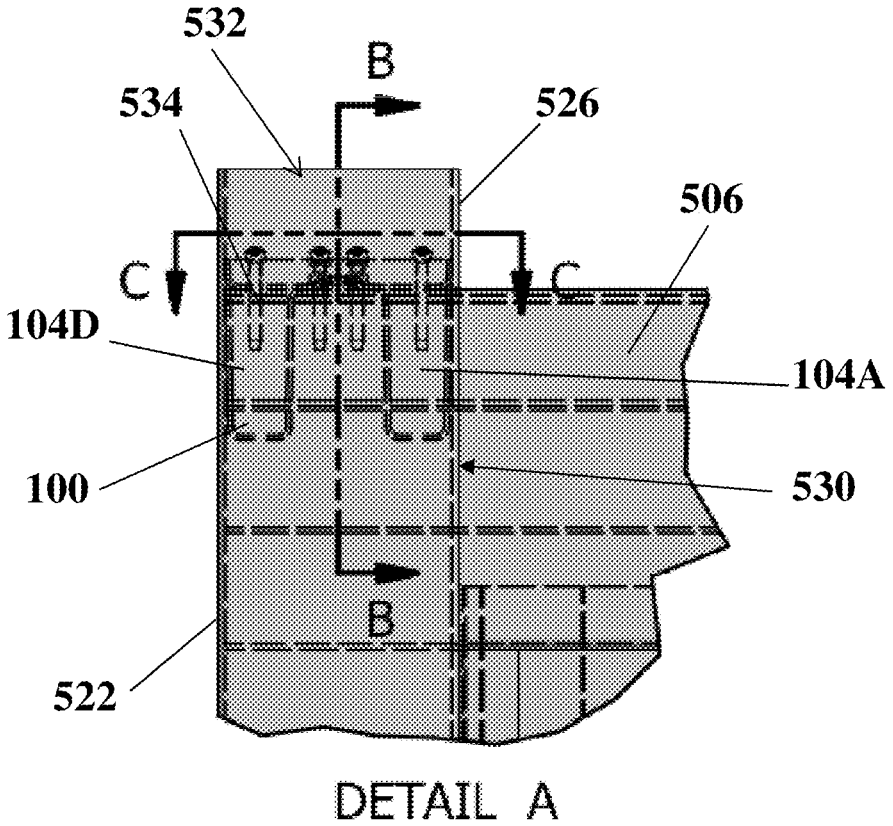
FIG. 7 is a side view of the gate corner of FIG. 6.
Figure 8:
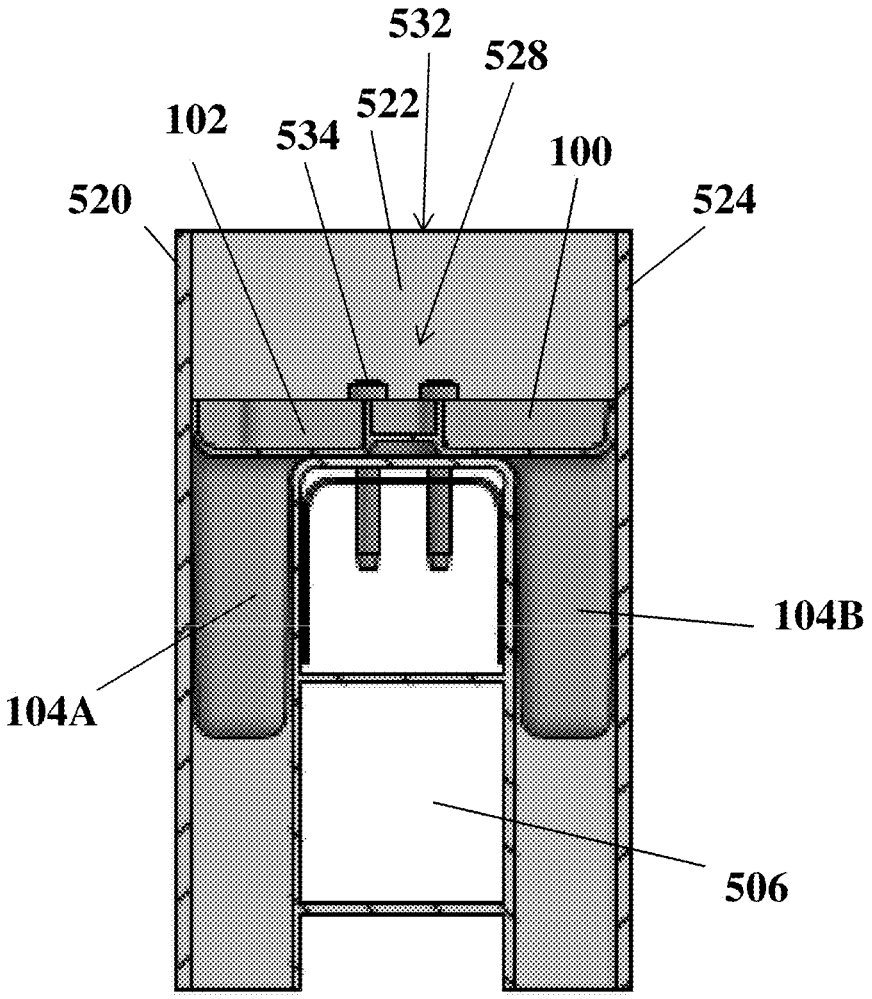
FIG. 8 is a section view of the gate corner of FIG. 7, taken along section line B-B.

With reference again to FIGS. 1-4, base 102 includes holes 120A-F that are dimensioned to receive fasteners 534 (FIGS. 7 and 8), e.g., screws or other similar mechanical fastener. For example, any mechanical fastener may be inserted through holes for engagement against or through a surface of a gate rail including, e.g., screws, nails, rivets, snap fits, tabs, etc. In some aspects, an adhesive, welding, plastic welding or other methods of attachment may be used. When a gate rail is inserted through any of openings 108, 110, 112, and 114 and cavity 106, fasteners may be inserted through holes 120A-F to secure the gate rail to the gate corner insert 100. In some aspects, the gate rail may also or alternatively be secured to the gate corner insert using an adhesive, plastic welding, or in any other manner.

Figure 2:
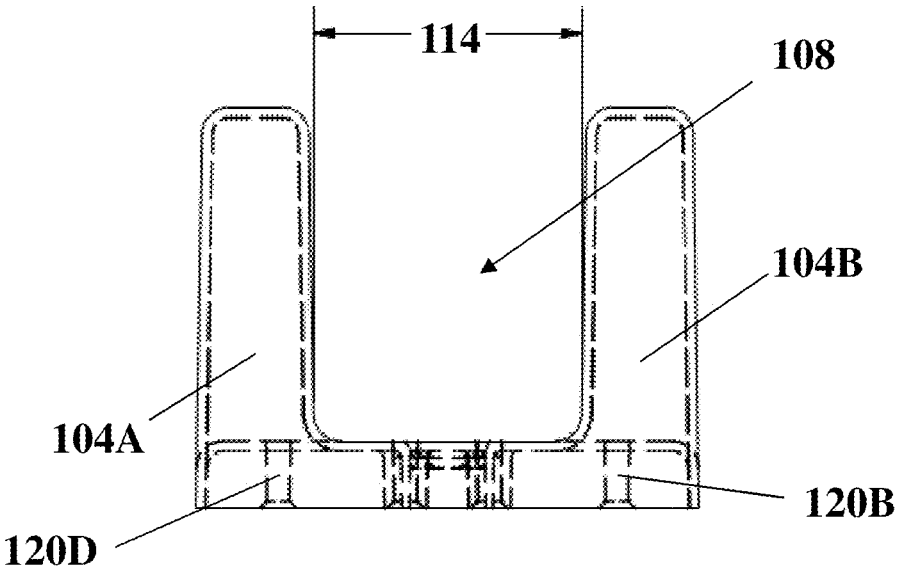
FIG. 2 is a front view of the gate corner insert of FIG. 1.
Figure 4:
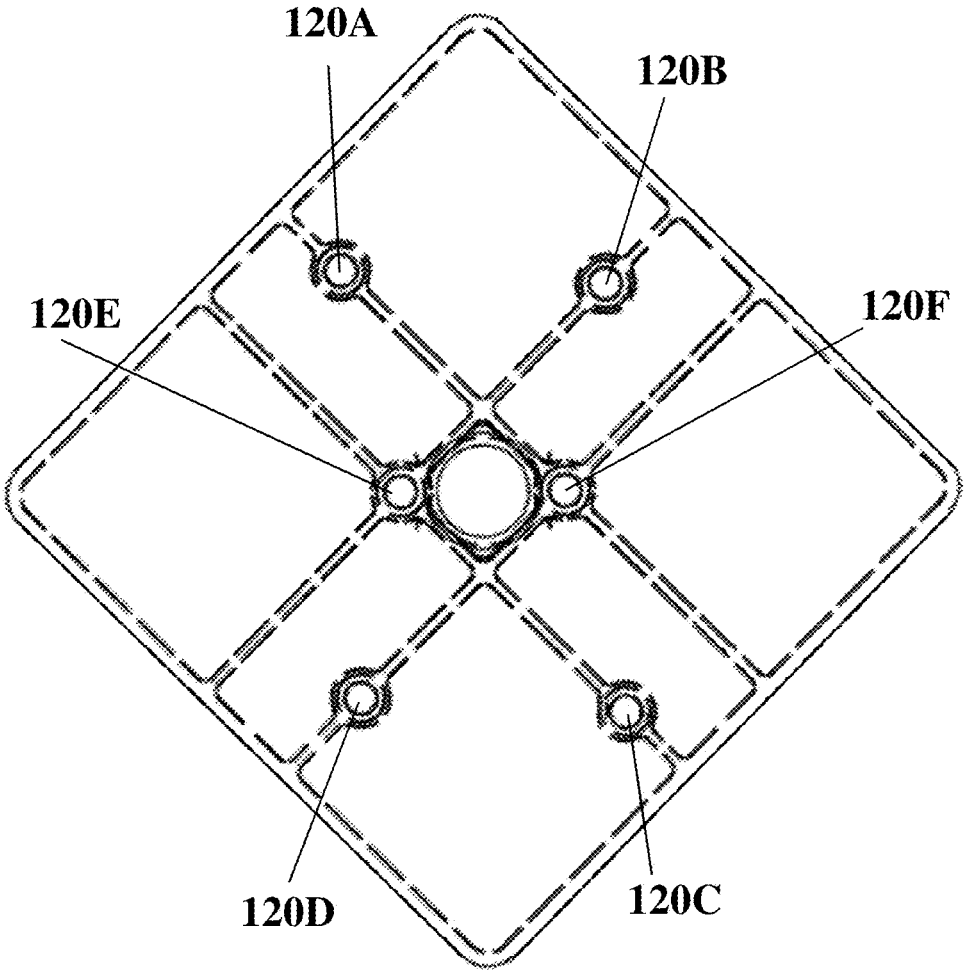
FIG. 4 is a bottom-up view of the gate corner insert of FIG. 1.
Figure 9:
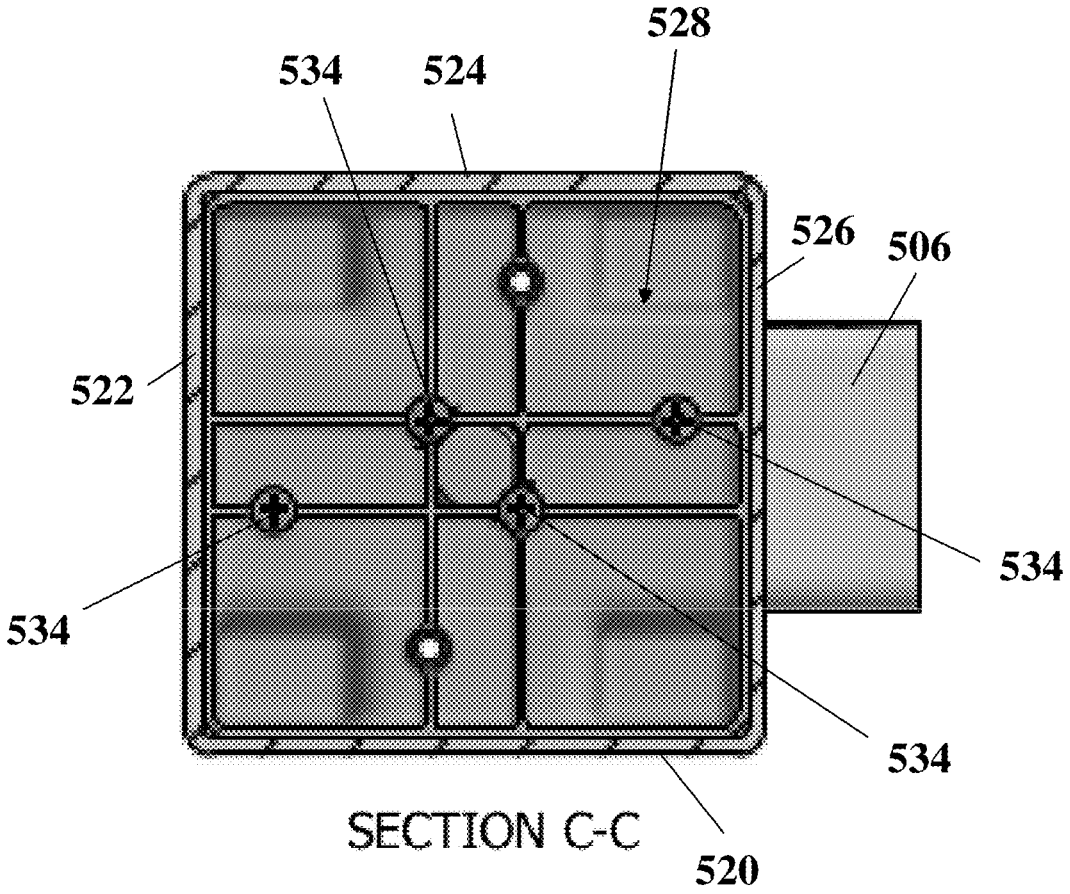
FIG. 9 is a section view of the gate corner of FIG. 7, taken along section line C-C.

In some aspects, fasteners may be inserted only through a subset of holes 120A-120F. For example, as illustrated in FIGS. 1, 2, and 4, holes 120B and 120D are not aligned in the first direction with openings 108 and 110. If the gate rail is inserted in the first direction through openings 108 and 110 and cavity 106, there may be no need to insert fasteners into holes 120B and 120D since the gate rail will not be positioned adjacent these holes. Instead, the fasteners may be inserted through holes 120A, 120C, 120E and 120F to secure the gate corner insert 100 to the gate rail. With reference to FIG. 9, for example, only four fasteners 534 are inserted through the holes.

Figure 3:
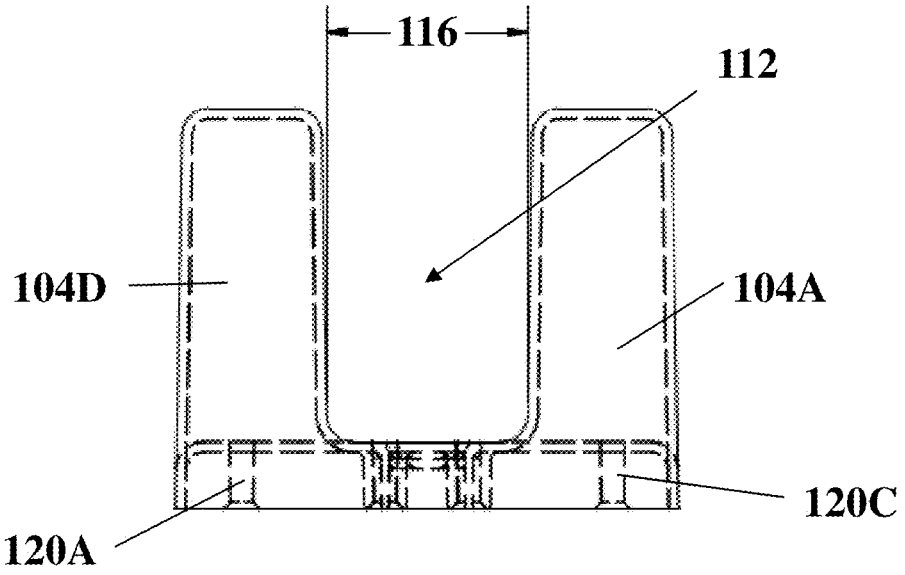
FIG. 3 is a side view of the gate corner insert of FIG. 1.

As another example, as illustrated in FIGS. 1, 3, and 4, holes 120A and 120C are not aligned in the second direction with openings 112 and 114. If the gate rail is inserted in the second direction through openings 112 and 114 and cavity 106, there may be no need to insert fasteners into holes 120A and 120C since the gate rail will not be positioned adjacent these holes. Instead, the fasteners may inserted through holes 120B, 120D, 120E and 120F to secure the gate corner insert 100 to the gate rail.

While six holes 120A-120F are illustrated, a larger of smaller number of holes may be present. For example, in some aspects, only holes 120E and 120F may be present. In some aspects, additional holes may be positioned adjacent cavity 106 in a similar manner to holes 120E and 120F for use in securing a gate rail inserted through cavity 106 in either of the first and second directions.

In some aspects, gate corner insert 100 may be formed from Polyvinyl chloride (PVC) or other plastic polymers, for example, by injection molding. In some aspects, gate corner insert 100 may be formed from a metal such as, e.g., aluminum.

Figure 5:
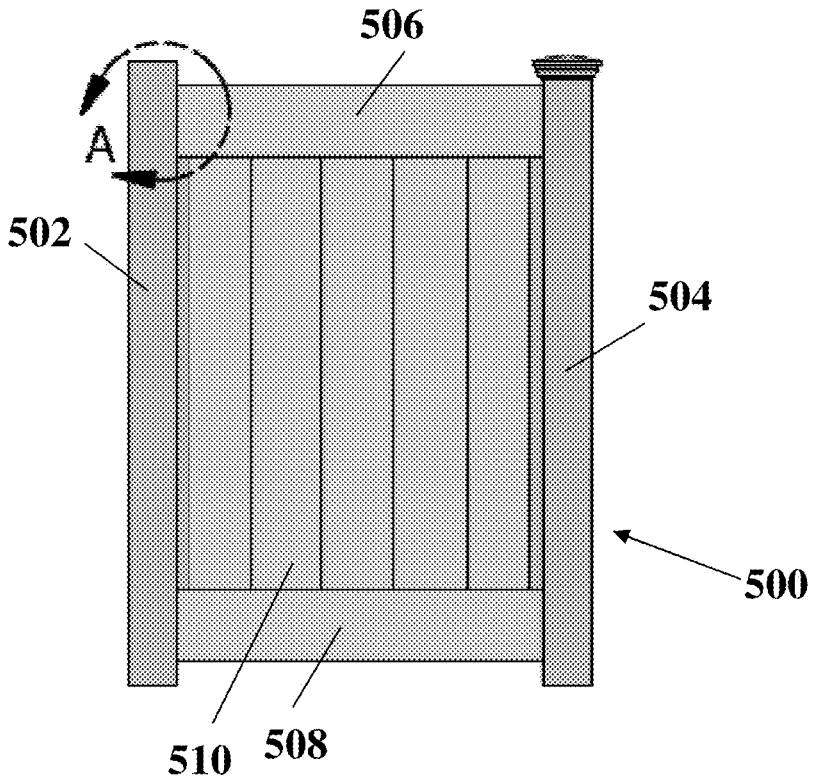
FIG. 5 is a front view of a gate in accordance with an aspect of the present disclosure.

With reference now to FIG. 5, an example gate assembly 500 is illustrated. Gate assembly 500 includes uprights 502 and 504, a top gate rail 506, a bottom gate rail 508, and boards 510. In some aspects, top and bottom rails 506 and 508 may include u-channel inserts. In some aspects, some or all of gate assembly 500 may be formed from a vinyl such as, e.g., Polyvinyl chloride (PVC), or may be formed of other plastic polymers. In some aspects, some or all of gate assembly 500 may be formed from metal or metallic materials including, e.g., aluminum, steel, or other metal or metallic materials.

Figure 6:
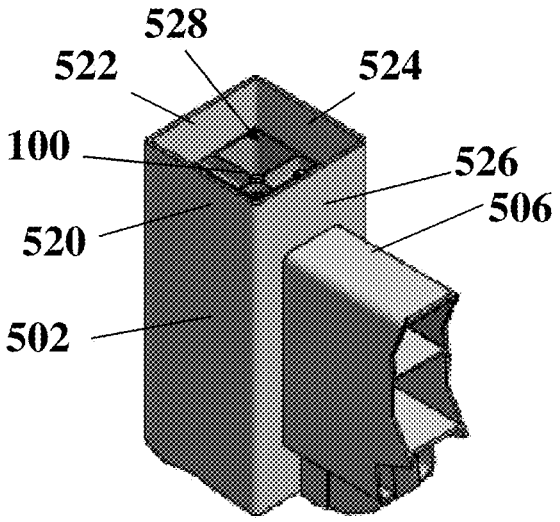
FIG. 6 is a perspective view of a gate corner of the gate of FIG. 5, called out by detail A.

With reference now to FIGS. 6-9, the interface between top gate rail 506 and upright 502 and a method of securing the top gate rail 506 to the upright is illustrated. As seen in FIG. 6, upright 502 includes walls 520, 522, 524, and 526 that define a cavity 528 therebetween.

Top gate rail 506 is inserted through an opening 530 in wall 526 of upright 502 and received within cavity 528. For example, opening 530 may be cut through wall 526 and dimensioned to receive top gate rail 506.

Gate corner insert 100 is inserted through an opening 532 in the top of upright 502, as defined by walls 520-526, and received within cavity 528. As illustrated in FIGS. 6-9, gate corner insert 100 is inserted with protrusions 104A-104D extending from base 102 in the insertion direction.

Gate corner insert 100 is positioned within cavity 528 such that top gate rail 506 is located between protrusions 104A-D in either the first or second direction (FIG. 1), depending on the width of the top gate rail. For example, gate corner insert 100 may be rotated prior to insertion into cavity 528 such that either openings 108, 110 or openings 112, 114 align with the insertion direction of top gate rail 506 and opening 530 of upright 502. In some aspects, the gate corner insert 100 may be inserted into cavity 528 first and top gate rail 506 may be inserted through openings 108, 110 or 112, 114.

In some aspects, top gate rail 506 may be inserted into cavity 528 first and gate corner insert 100 may be translated through cavity 528 toward top gate rail 506 until protrusions 104A-D are proximate to or abutting top gate rail 506. In some aspects, gate corner insert 100 may be translated through cavity 528 toward top gate rail 506 until top gate rail 506 is proximate to or abutting base 102.

Once top gate rail 506 and gate corner insert 100 have been inserted into cavity 528 and positioned as described above, fasteners 534 are inserted through holes 120A-120F, or a subset thereof, and into top gate rail 506 to removably attach or secure gate corner insert 100 to top gate rail 506. As illustrated in FIG. 9, for example, fasteners 534 may be inserted through the four holes that align with the top gate rail 506.

By assembling the gate corner as described above, top gate rail 506 is inhibited from removal from upright 502 by gate corner insert 100. In addition, protrusions 104A-D inhibit lateral movement of top gate rail 506 relative to the insertion direction of top gate rail 506, thereby providing a secure attachment of top gate rail 506 to upright 502.

While gate corner insert 100 is described above for use in securing top gate rail 506 to upright 502, gate corner insert 100 may also be used to secure top gate rail 506 to upright 504, bottom gate rail 508 to upright 502, bottom gate rail 508 to upright 504, or any other junction between a gate or fence rail and an upright or post.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A gate corner insert for insertion into an upright, the upright having a plurality of walls defining an inner surface of the upright, the gate corner insert comprising:

a base surface having four corners defining an outer perimeter, the outer perimeter of the base surface sized to fit within the inner surface of the upright; and a plurality of protrusions, each protrusion extending directly from a respective corner of the outer perimeter of the base surface, the base surface and the plurality of protrusions defining a cavity therebetween, first and second protrusions of the plurality of protrusions defining a first opening therebetween, the first opening extending along the base surface in communication with the cavity, the first opening and the cavity configured to receive a gate rail inserted through one of the plurality of the walls of the upright for removable attachment to the gate corner insert, the removable attachment inhibiting removal of the gate rail from the first opening.

2. The gate corner insert of claim 1, wherein the base includes at least one hole extending therethrough, the at least one hole configured to receive a fastener therethrough for engagement against the gate rail when the gate rail is received within the first opening and the cavity, the engagement of the fastener against the gate rail removably attaching the gate rail to the gate corner insert.

3. The gate corner insert of claim 1, wherein third and fourth protrusions of the plurality of protrusions define a second opening therebetween, the second opening extending along the base surface in communication with the cavity, the second opening disposed on an opposite side of the cavity from the first opening and configured to receive the gate rail therein.

4. The gate corner insert of claim 1, wherein the first and second protrusions inhibit lateral movement of the gate rail when the gate rail is received within the cavity and the first opening.

5. The gate corner insert of claim 1, wherein a third protrusion of the plurality of protrusions and the first protrusion define a third opening therebetween, the third opening extending along the base surface in communication with the cavity, the first opening having a first width and the third opening having a second width, the second width being different than the first width, the third opening configured to receive a gate rail therein that has a different width than the width of a gate rail that the first opening is configured to receive.

6. The gate corner insert of claim 5, wherein the first opening is configured to receive a gate rail in a first direction, wherein the third opening is configured to receive a gate rail in a second direction, and wherein the first direction is orthogonal to the second direction.

7. The gate corner insert of claim 6, wherein the first and second directions are orthogonal to a direction that the plurality of protrusions extend from the base.

* * * * *